US009393677B2

(12) United States Patent
Bothmann

(10) Patent No.: US 9,393,677 B2
(45) Date of Patent: Jul. 19, 2016

(54) IMPACT WRENCH ANVIL

(71) Applicant: Snap-on Incorporated, Kenosha, WI (US)

(72) Inventor: Rich D. Bothmann, Grayslake, IL (US)

(73) Assignee: Snap-on Incorporated, Kenosha, WI (US)

( * ) Notice: Subject to any disclaimer, the term of this patent is extended or adjusted under 35 U.S.C. 154(b) by 474 days.

(21) Appl. No.: 13/896,642

(22) Filed: May 17, 2013

(65) Prior Publication Data

US 2014/0338943 A1 Nov. 20, 2014

(51) Int. Cl.
*B25B 21/02* (2006.01)

(52) U.S. Cl.
CPC ..... *B25B 21/026* (2013.01)

(58) Field of Classification Search
CPC ..... B25B 21/02
USPC ..... 173/93, 93.5, 93.6, 104, 205
See application file for complete search history.

(56) References Cited

U.S. PATENT DOCUMENTS

| | | | | |
|---|---|---|---|---|
| 6,024,180 | A | 2/2000 | Lin | |
| 7,331,404 | B2 * | 2/2008 | Pusateri | B25B 21/02 173/93 |
| 7,510,023 | B1 * | 3/2009 | Cheng | B25B 21/02 173/93 |
| 8,141,654 | B2 * | 3/2012 | Lin | B25B 21/02 173/104 |
| 2006/0157261 | A1 | 7/2006 | Chen | |
| 2011/0005788 | A1 | 1/2011 | Chen | |

FOREIGN PATENT DOCUMENTS

| | | | |
|---|---|---|---|
| CN | 2197177 | Y | 5/1995 |
| CN | 1334177 | A | 2/2002 |
| CN | 201437237 | U | 4/2010 |
| DE | 102007007078 | | 6/2008 |
| EP | 1174222 | A3 | 1/2003 |
| TW | 404880 | | 9/2000 |
| TW | M274210 | | 9/2005 |

OTHER PUBLICATIONS

Canadian Intellectual Property Office, Patent Examiner's Report, dated Aug. 10, 2015; 3 pages.
Australian Patent Examination Report, dated May 4, 2015; 3 Pages.
United Kingdom Intellectual Property Office, Examination Report dated Aug. 17, 2015; 3 pages.
Combined Search and Examination Report for GB1407718.4, dated Aug. 8, 2014.
ROC Taiwan Search Report for Patent Application No. 103116741, with English translation, dated Dec. 25, 2015; 8 pages.
State Intellectual Property Office of P.R. China, The Second Office Action, dated Mar. 9, 2016; 7 pages.

* cited by examiner

*Primary Examiner* — Nathaniel Chukwurah
(74) *Attorney, Agent, or Firm* — Seyfarth Shaw LLP

(57) ABSTRACT

An anvil is disclosed having wings with additional surface area compared to prior art impact wrench anvils. The wings engage respective hammers in a radial direction, and overlap with one another in an axial direction across the interface between the two hammers. The hammers can each include a recess so that one wing does not engage the hammer associated with the other wing. In an embodiment, the surface of the wing can be angled to increase the amount of material extending over the hammer interface.

8 Claims, 4 Drawing Sheets

IMPACT WRENCH ANVIL

TECHNICAL FIELD OF THE INVENTION

The present application relates to anvils for impact wrenches. More particularly, the present application relates to an anvil having impact wings with increased material to improve resistance to fatigue.

BACKGROUND OF THE INVENTION

Impact wrenches are commonly used to remove work pieces, such as threaded fasteners, from a working material. A motor drives the hammer rotationally by initiating quick pulses of power, either through electrical, pneumatic or other means. The anvil, which is disposed interior of the impact wrench, includes wings that interact with the hammers and transfer the impacting force from the hammers to the work piece. For example, a first wing on the anvil can engage a first hammer, and a second wing spaced axially from the first wing can engage a second hammer. The wings each engage their respective hammer approximately every 360 degrees of rotation.

Current impact wrench anvils include wings with rectangular surfaces, such as that shown in FIG. 7. The anvil 700 of FIG. 7 includes a first wing 705 with a first surface 710, and a second wing 715 with a second surface 720. The two surfaces 710, 720 are rectangular and do not overlap one another in a circumferential or axial direction. In other words, the first and second surfaces 710, 720 are diametrically opposed and axially spaced relative to each other. That is, the first wing 705 is adapted to engage a first hammer, and the second wing 715 is adapted to engage a second hammer. If the wings 705, 715 axially overlapped with one another, the first wing would engage the second hammer, and the second wing would engage the first hammer which would prevent the hammers from rotating relative to the anvil.

SUMMARY OF THE INVENTION

The present application discloses an anvil for an impact wrench with wings having greater impact resistance to the current anvils, thus increasing the tool's reliability and usable life. To achieve this, the anvil of the present application increases the amount of material on the wing by overlapping the wings with one another across the interface between the two hammers. The hammers can each include a recess so that one overlapping wing does not engage the other wing's hammer. In an embodiment, the surface of the wing can also be angled to increase the amount of material extending over the hammer interface to improve strength.

In particular, the present application discloses a tool for applying an impact force to a work piece, the tool including an anvil having a shaft extending in an axial direction and rotatable in a radial direction, first and second hammers each adapted to rotate about the shaft and being disposed proximate one another along a hammer interface, and first and second wings laterally disposed on the shaft and extending in the axial direction, the first and second wings overlapping one another in the axial direction across the hammer interface to define respective first and second overlapping portions, wherein the first and second hammers each defines a recess adapted to receive the first and second overlapping portions, respectively, during rotation of the first and second hammers.

Also disclosed is an anvil for applying an impact force to a work piece, the anvil adapted to be engaged by first and second hammers disposed proximate one another along a hammer interface and rotating about the anvil, the anvil including a shaft extending in an axial direction and rotatable in a radial direction, first and second wings disposed on the shaft and extending in the axial direction along the shaft, the first and second wings overlapping one another in the axial direction across the hammer interface to define respective first and second overlapping portions.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

Figure 1:
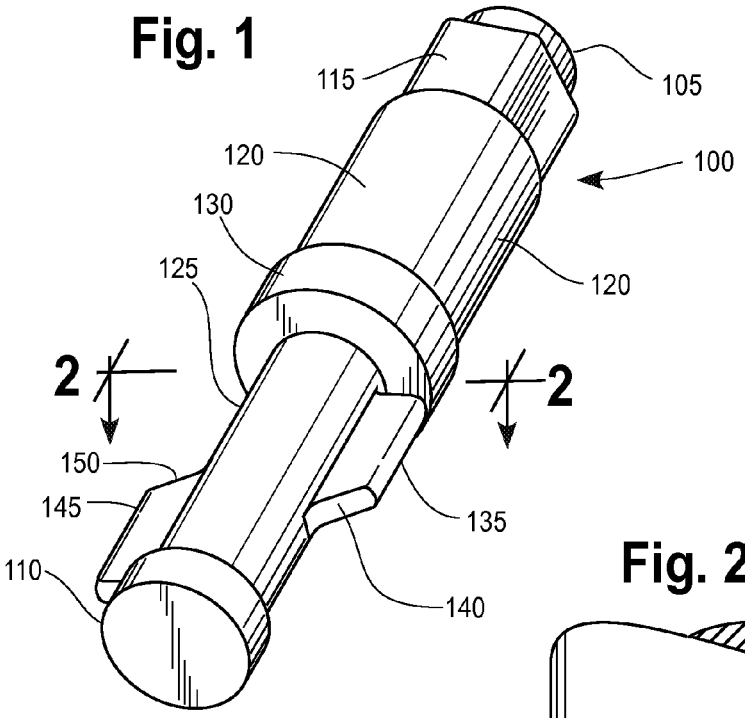
FIG. 1 is a perspective side view of an anvil for an impact wrench in accordance with an embodiment of the present application.

It should be understood that the comments included in the notes as well as the materials, dimensions and tolerances discussed therein are simply proposals such that one skilled in the art would be able to modify the proposals within the scope of the present application.

DETAILED DESCRIPTION OF THE EMBODIMENTS

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated.

The present application discloses an anvil for an impact wrench having wings with additional material as compared to current prior art wrench anvils. The anvil of the present application includes wings adapted to engage respective hammers in a radial direction, and that overlap with one another across the interface between the two hammers. The hammers can each include a recess where one overlapping wing does not engage the hammer associated with the other overlapping wing. In an embodiment, the surface of the wing can also be angled, thereby increasing the amount of material extending over the hammer interface to better absorb the impact force on the wing.

Figure 2:
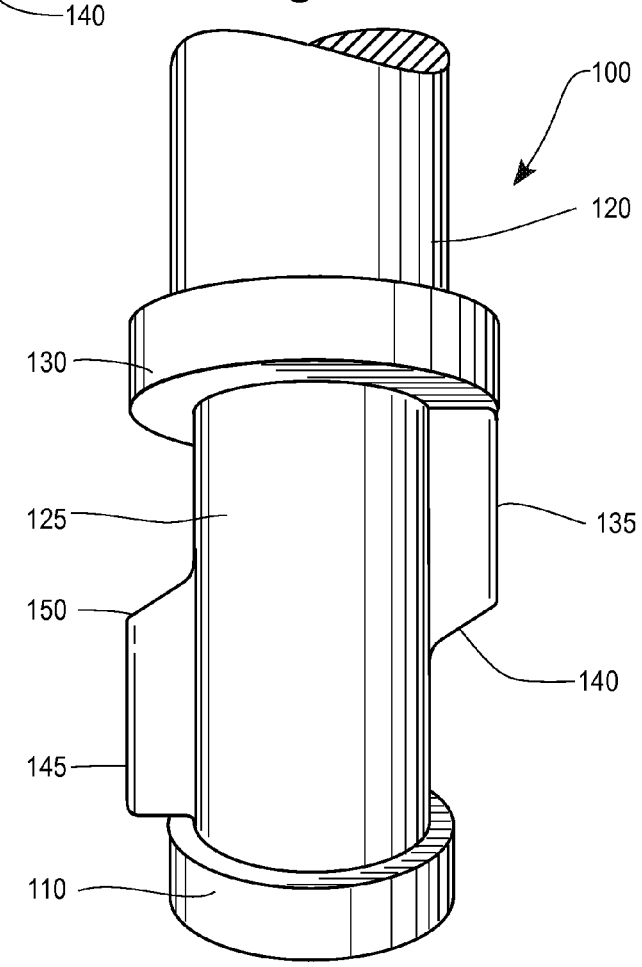
FIG. 2 is a magnified side view of a portion of an anvil in accordance with an embodiment of the present application.
Figure 3:
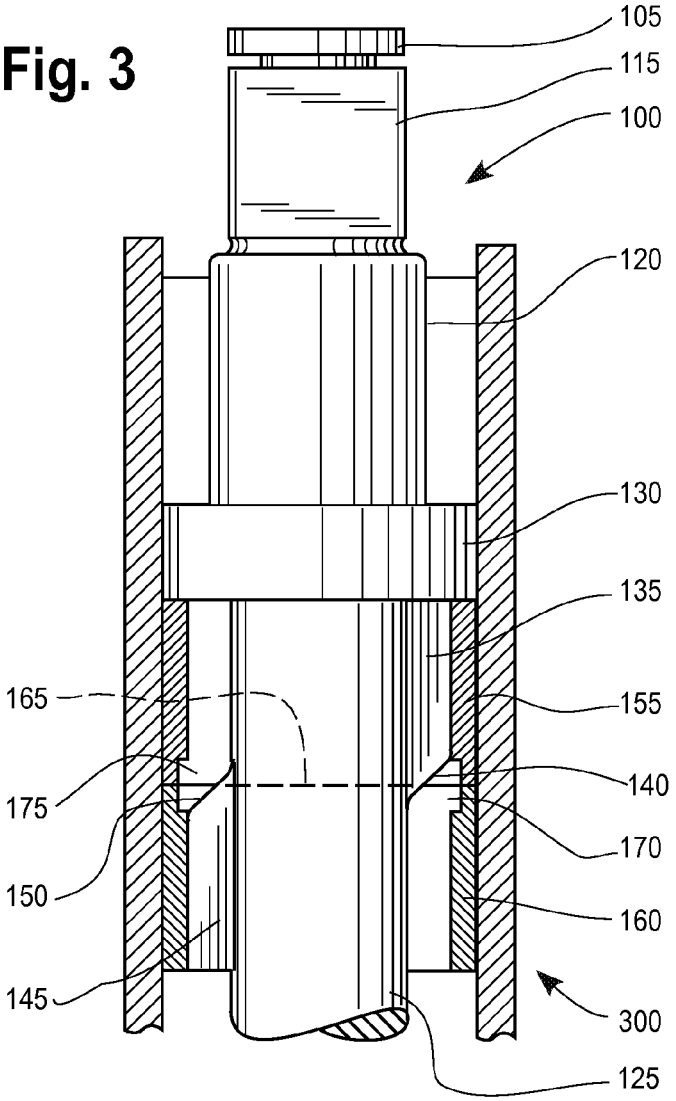
FIG. 3 is a side cross-sectional view of an anvil located within an impact wrench in accordance with an embodiment of the present application.

As shown in FIGS. 1 and 2, the anvil 100 includes a first end 105 and a second end 110 opposite the first end. An impact head 115 can be located proximate the first end 105 and can be coupled to a base 120 of the anvil 100 in an axial direction. A shaft 125 can be disposed between the second end 110 and a circumferential flange 130. A first wing 135 with a first surface 140 and a second wing 145 with a second surface 150 can also be located along the shaft 125, for example, extending axially along the shaft 125. In an embodiment, the first wing 135 can extend from the flange 130 and the second wing 145 can extend along the second end 110. As shown in FIG. 3, the anvil 100 can be disposed within a tool 300, such as an impact wrench, and be axially and rotatably movable within the tool 300.

The first and second wings 135, 145 can overlap with one another in the axial direction. For example, as shown in FIG. 3, the first and second wings 135, 145 can be disposed proximate the first and second hammers 155, 160, respectively, and can receive impacting force from the first and second hammers 155, 160 and transfer the impacting force to the work piece in a well-known manner. In an embodiment, the first and second hammers 155, 160 border each other at a hammer interface 165 and the first and second wings 135, 145 can extend across the hammer interface 165 to provide more material for the wings 135, 145 as compared to prior anvil wings. That is, prior art anvil wings only extend to the interface and have a flat or rectangular surface interface, and therefore lack the additional material that the present application provides to the first and second wings 135, 145. This additional material provides added fatigue resistance to the first and second 135, 145 wings as compared to prior art anvil wings, by providing better impact force distribution. The portion of the wings 135, 145 extending across the hammer interface 165 can be herein referred to as the first and second overlapping portions, respectively.

To account for the added overlapping material, the first and second hammers 155, 160 can respectively include first and second recesses 170, 175. The recesses 170, 175 allow for the overlapping wings 135, 145 to extend across the hammer interface 165 without the overlapping portions simultaneously engaging the rotating hammers 155, 160. For example, as shown in FIG. 3, the first hammer 155 is adapted to rotate relative to the first wing 135 and engages the first wing 135 once per rotation. However, even though the second wing 145 crosses over the hammer interface 165, the first recess 170 provides adequate clearance so that the second wing 145 does not engage the first hammer 155, and only engages the second hammer 160.

Figure 4:
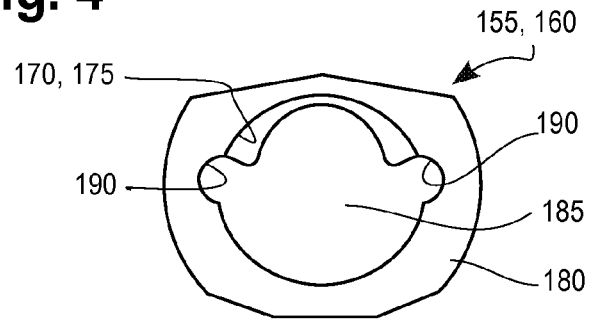
FIG. 4 is a top plan view of a hammer for use with an impact wrench in accordance with an embodiment of the present application.
Figure 5:
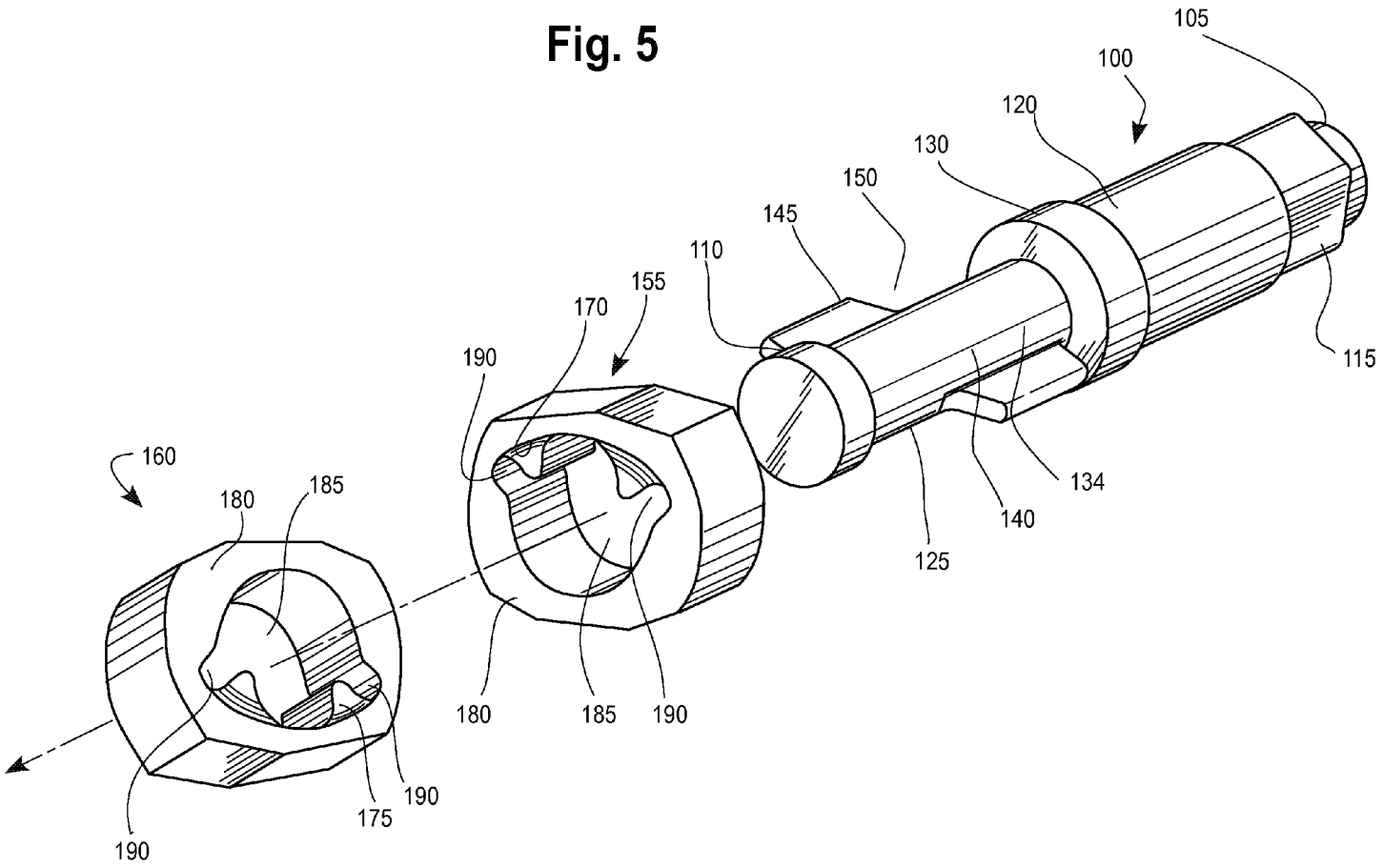
FIG. 5 is a top plan view of an anvil and hammers removed from an impact wrench and disassembled in accordance with an embodiment of the present application.

FIG. 4 illustrates a hammer 155, 160 in accordance with an embodiment of the present application, and FIG. 5 illustrates the hammers 155, 160 in exploded view proximate the anvil, with the anvil 100 and hammer 155, 160 disassembled and removed from the tool. As shown, the hammers 155, 160 are similarly shaped and sized, and can include a recess 170, 175 adapted to receive the overlapping portions of the first and second wings 135, 145 that extend across the hammer interface 165 to provide the wings 135, 145 with more material as compared to prior art anvil wings. The hammer 155, 160 can also include a perimeter 180 extending in an elliptical, circular, or otherwise arcuate manner, or in any other shape. The perimeter 180 and recess 170, 175 cooperatively define an opening 185 having one or more receiving areas 190 for receiving the wings 135, 145 when the hammers 155, 160 rotate about the wings 135, 145.

Although the first and second surfaces 140, 150 can be any shape, they are shown in FIGS. 1-5 as being angled or slanted relative to the shaft 125. It has been discovered that, many times, fatigue-related failure occurs at the root of the rectangular-faced wings in prior art anvils. However, the angled or slanted surfaces 140, 150 of the present application add additional material to the wings 135, 145 and, due to their shape, are stronger than prior art anvil wings.

Figure 6:
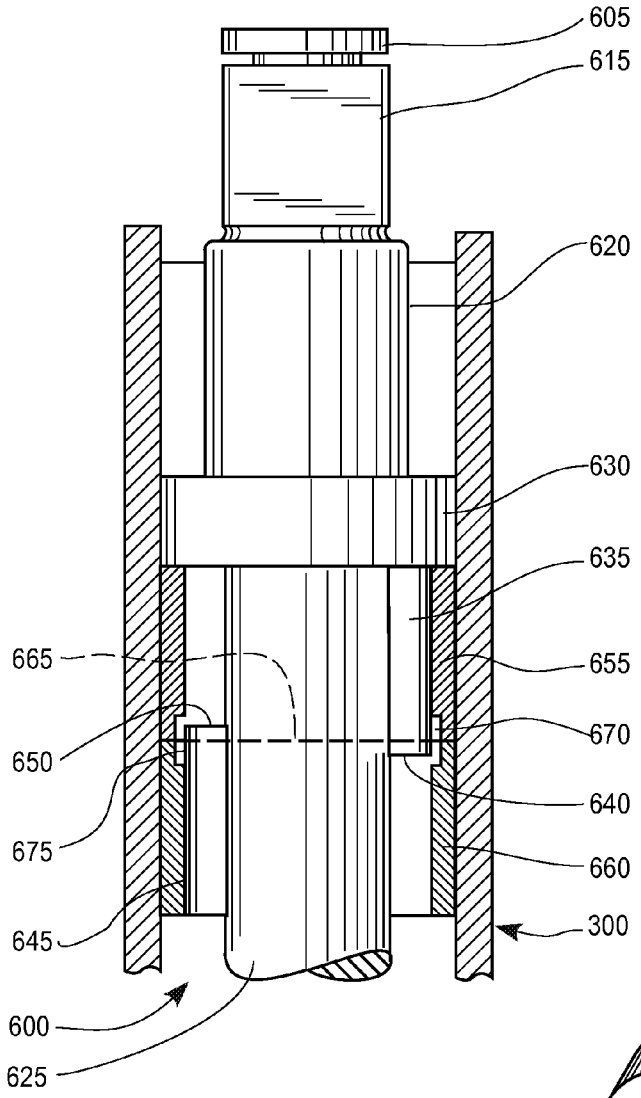
FIG. 6 is a side cross-sectional view of an anvil located within an impact wrench in accordance with an embodiment of the present application.
Figure 7:
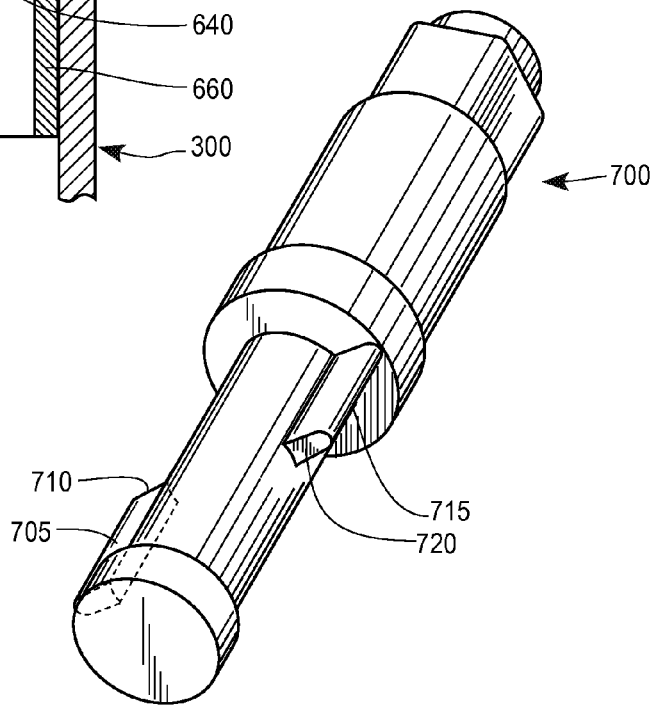
Fig. 7 Prior Art
FIG. 7 is a perspective side view of a prior art anvil adapted for use with an impact wrench.

FIG. 6 illustrates an embodiment of the present application similar to that shown in FIGS. 1-5, with like features represented by like numerals. As shown in FIG. 6, the surfaces 140, 150 of the present invention need not be slanted, but can be surfaces 640, 650 that are orthogonal relative to the shaft 625 and that overlap a hammer interface 665. The hammers 655, 660 can include corresponding recesses to account for the overlapping portion of the wings 635, 645. The rectangular surface 640, 650 shown in FIG. 6 is advantageous by allowing added material and mass to the wings 635, 645 as compared to the angle embodiment of FIGS. 1-5.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A tool for applying an impact force to a work piece, comprising:

an anvil having an axial shaft rotatable about a longitudinal axis;

first and second hammers rotatable about the shaft and disposed proximate one another along a hammer interface, each of the first and second hammers including a recess; and first and second wings laterally disposed on and extending radially from the shaft, the first and second wings respectively having first and second surfaces extending diagonally in radial and axial directions, wherein the first and second surfaces overlap one another along the hammer interface and are adapted to be respectively disposed in the recesses of the first and second hammers during rotation of the first and second hammers.

2. The tool of claim 1, further comprising a flange circumferentially disposed around the shaft, wherein the first wing extends axially from the flange along the shaft.

3. The tool of claim 1, wherein the second wing extends axially along the shaft from an end of the shaft.

4. The tool of claim 1, further comprising an impact head disposed proximate an end of the shaft and adapted to provide the impact force to the work piece.

5. An anvil for applying an impact force to a work piece, the anvil engagable by first and second hammers disposed proximate one another along a hammer interface and rotating about the anvil, each of the first and second hammers including a recess, the anvil comprising:

an axial shaft rotatable about an axis; and first and second wings extending radially from the shaft in an axial direction along the shaft, the first and second wings respectively having first and second overlapping surfaces extending diagonally in radial and axial directions, wherein the first and second surfaces overlap one another along the hammer interface and are adapted to be respectively disposed in the recesses of the first and second hammers during rotation of the first and second hammers.

6. The anvil of claim 5, further comprising a flange circumferentially disposed around the shaft, wherein the first wing axially extends from the flange along the shaft.

7. The anvil of claim 5, wherein the second wing extends axially along the shaft from an end of the shaft.

8. The anvil of claim 5, further comprising an impact head disposed proximate an end of the shaft and adapted to provide the impact force to the work piece.

* * * * *